US007815984B2

(12) United States Patent
Yoshino et al.

(10) Patent No.: US 7,815,984 B2
(45) Date of Patent: Oct. 19, 2010

(54) RECORDING MEDIUM AND IMAGE FORMING METHOD USING THE SAME

(75) Inventors: Hitoshi Yoshino, Zama (JP); Toshio Suzuki, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 1112 days.

(21) Appl. No.: 11/481,794

(22) Filed: Jul. 7, 2006

(65) Prior Publication Data

US 2007/0013761 A1 Jan. 18, 2007

(30) Foreign Application Priority Data

Jul. 12, 2005 (JP) ..... 2005-203047
Jul. 7, 2006 (JP) ..... 2006-187840

(51) Int. Cl.
*B41M 5/50* (2006.01)

(52) U.S. Cl. ..... 428/32.21; 428/32.18

(58) Field of Classification Search ..... None
See application file for complete search history.

(56) References Cited

U.S. PATENT DOCUMENTS

| | | | | |
|---|---|---|---|---|
| 4,269,891 | A | 5/1981 | Minagawa | 428/335 |
| 4,723,129 | A | 2/1988 | Endo et al. | 346/1.1 |
| 4,740,796 | A | 4/1988 | Endo et al. | 346/1.1 |
| 4,849,774 | A | 7/1989 | Endo et al. | 346/140 R |
| 5,122,814 | A | 6/1992 | Endo et al. | 346/33 R |
| 5,159,349 | A | 10/1992 | Endo et al. | 346/33 A |
| 5,213,873 | A | 5/1993 | Yasuda et al. | 428/195 |
| 5,521,621 | A | 5/1996 | Endo et al. | 347/15 |
| 5,635,291 | A | 6/1997 | Yoshino et al. | 428/304.4 |
| 5,679,451 | A | 10/1997 | Kondo et al. | 428/304.4 |
| 5,707,716 | A | 1/1998 | Yoshino et al. | 428/212 |
| 5,738,932 | A | 4/1998 | Kondo et al. | 428/195 |
| 5,754,194 | A | 5/1998 | Endo et al. | 347/15 |
| 5,800,916 | A | 9/1998 | Yoshino et al. | 428/328 |
| 5,804,320 | A | 9/1998 | Tomioka et al. | 428/478.2 |
| 5,846,647 | A | 12/1998 | Yoshino et al. | 428/328 |
| 5,851,654 | A | 12/1998 | Yoshino et al. | 428/328 |
| 5,869,177 | A | 2/1999 | Yoshino et al. | 428/328 |
| 5,955,185 | A | 9/1999 | Yoshino et al. | 428/304.4 |
| 5,962,124 | A | 10/1999 | Yoshino et al. | 428/328 |
| 5,985,076 | A * | 11/1999 | Misuda et al. | 156/230 |
| 6,000,794 | A | 12/1999 | Kondo et al. | 347/105 |
| 6,177,188 | B1 | 1/2001 | Ichioka et al. | 428/342 |
| 6,342,289 | B1 | 1/2002 | Eguchi et al. | 428/195 |
| 6,576,324 | B2 | 6/2003 | Yoshino et al. | 428/195 |
| 6,649,661 | B2 | 11/2003 | Yoshino et al. | 516/93 |
| 6,706,340 | B2 | 3/2004 | Yoshino et al. | 428/32.21 |
| 6,716,495 | B1 | 4/2004 | Yoshino et al. | 428/32.16 |
| 6,720,041 | B2 | 4/2004 | Yoshino et al. | 428/32.24 |

(Continued)

FOREIGN PATENT DOCUMENTS

| | | |
|---|---|---|
| JP | S54-059936 | 5/1979 |

(Continued)

*Primary Examiner*—Bruce H Hess
(74) *Attorney, Agent, or Firm*—Fitzpatrick, Cella, Harper & Scinto

(57) ABSTRACT

The invention provides a recording medium comprising a porous cellulose layer containing at least one cellulose selected from the group consisting of lightly-beaten cellulose pulp, mercerized cellulose and fluffed cellulose and a porous filler internally loaded therein, and a recording medium further comprising an ink-receiving layer.

17 Claims, 5 Drawing Sheets

U.S. PATENT DOCUMENTS

| | | | | |
|---|---|---|---|---|
| 6,945,646 | B2 | 9/2005 | Ogino et al. | 347/105 |
| 7,144,613 | B2 | 12/2006 | Eguchi et al. | 428/32.37 |
| 2006/0078697 | A1 | 4/2006 | Yoshino | 428/32.34 |

FOREIGN PATENT DOCUMENTS

| | | |
|---|---|---|
| JP | S55-005158 | 1/1980 |
| JP | S55-005830 | 1/1980 |
| JP | H02-270588 | 11/1990 |
| JP | H03-038376 | 2/1991 |
| JP | H03-199081 | 8/1991 |
| JP | H07-090659 | 4/1995 |
| JP | H07-276786 | 10/1995 |
| JP | H08-000667 | 1/1996 |
| JP | H08-300809 | 11/1996 |
| JP | H11-229289 | 8/1999 |
| JP | 2000-158805 | 6/2000 |
| JP | 2001-253160 | 9/2001 |
| JP | 2002-002092 | 1/2002 |
| JP | 2002-154268 | 5/2002 |
| JP | 2003-293284 | 10/2003 |
| JP | 2004-066492 | 3/2004 |

* cited by examiner

RECORDING MEDIUM AND IMAGE FORMING METHOD USING THE SAME

BACKGROUND OF THE INVENTION

1. Field of the Invention

The present invention relates to a recording medium and an image forming process using this recording medium, and particularly to a recording medium comprising a porous cellulose layer of a low density, or a recording medium, in which an ink receptive layer is provided on a substrate composed of a porous cellulose layer of a low density. More particularly, the present invention relates to a recording medium, which can provide a clear and high-quality recorded image and can relieve a phenomenon called cockling wherein a printed surface is waved by an aqueous ink.

2. Related Background Art

In recent years, an ink-jet recording system, in which minute droplets of ink are caused to flow by any one of various working principles to apply them to a recording medium such as paper, thereby making a record of images, characters and/or the like, has frequently been used. A recording apparatus of this system has such a feature that printing can be conducted at high speed and with a low noise, color images can be formed with ease, printing patterns are very flexible, and development and fixing process are unnecessary. Therefore, it has been quickly spread as a recording apparatus for various images in various applications including information instruments. Further, images formed by a multi-color ink-jet system are comparable with those of multi-color prints with a plate making system and photoprints with a color photographic system. Therefore, such images can be obtained at lower cost than the usual multi-color prints and photoprints when the number of copies is small. It thus begins to be widely applied to a field of recording of full-color images.

With the enlarged utilization of the ink-jet recording system, further improvements in recording properties such as speeding up and high definition of recording, and full-coloring of images are required, so that recording apparatus and recording methods have been improved up to date. On the other hand, recording media have also been required to have higher properties. More specifically, the recording media are required to have the following properties:

a) providing printed dots high in density and bright and vivid in color tone upon forming images;

b) having high ink absorption rate and absorption capacity so as for an ink not to run out or bleed in case printed dots overlap each other;

c) preventing printed dots from diffusing in a lateral direction beyond need;

d) providing printed dots having a substantially round shape, and smooth and clear in periphery, and e) having high whiteness degree and glossiness.

In order to meet such requirements, a wide variety of recording media have heretofore been proposed. For example, there has been proposed ink-jet recording paper, in which a coating layer having good ink absorbency is provided on a surface of a substrate (see Japanese Patent Application Laid-Open No. S55-005830). There has been also proposed the use of amorphous silica as a pigment in an ink-receiving layer laminated on a substrate for recording medium (see Japanese Patent Application Laid-Open No. S55-005158).

With the diversification of uses of recording media, it has also been required to reduce the occurrence of curling or cockling of printed articles for the purpose of improving the quality of recorded images. In the present invention, cockling means a phenomenon that a printed surface of a recording medium is made irregular or waved.

As means for avoiding this cockling phenomenon, there have heretofore been proposed the following methods.

(1) Japanese Patent Application Laid-Open Nos. H03-038376, H03-199081, H07-276786 and H08-300809 describe recording media using paper having an underwater elongation and a wetted elongation within respective specified ranges.

(2) The constitutions in which an ink-receptive layer containing a water-repellent component (Japanese Patent Application Laid-Open No. 2000-158805) or a void layer formed of a thermoplastic resin such as polyurethane (Japanese Patent Application Laid-Open No. 2002-154268) are respectively provided as intermediate layers for barrier preventing penetration of ink between an ink-receiving layer and a substrate is described.

(3) Proposals for the solution, which are different from the methods in the above-described publicly known documents, include the following proposals. Namely, the proposals comprise providing an additional structure on a recording medium. A recording medium, in which ink-receptive layers are provided on both surfaces of a substrate, a recording medium, in which a back coat layer is provided on a surface opposite to an ink-receiving layer, and a recording medium, in which substrates are laminated on each other into a two-layer structure, are described in Japanese Patent Application Laid-Open Nos. H02-270588, 2001-253160 and 2002-002092, respectively.

Since the technical ideas described in Japanese Patent Application Laid-Open Nos. H03-038376, H03-199081, H07-276786 and H08-300809 are based on the premise that water is evenly given to the whole part of a recording medium, however, they cannot cope with a case where liquids different in properties are applied to every part like ink-jet recording. In addition, since the intermediate layers described in Japanese Patent Application Laid-Open Nos. 2000-158805 and 2002-154268 both act as a barrier which prevents penetration of ink, the ink printed do not penetrate into the substrate when the quantity of ink printed is great. As a result, the quantity of ink absorbed is reduced, and an ink-absorbing rate is lowered, so that ink overflowing and/or bleeding may be caused in some cases.

The present inventor has carried out an investigation on various kinds of the recording media proposed in the prior art documents mentioned above and found that on all the recording media, the following problems are involved.

(1) The effect to prevent cockling may have not been obtained in some cases according to the basis weight and thickness of the recording medium. In particular, cockling has markedly occurred when the thickness of the recording medium is as thin as 150 μm or smaller. More specifically, this is attributable to the circumstance that since the recording medium is swollen by ink absorption, and causes shrinkage in a drying step, the stiffness of the recording medium is lowered when the thickness of the recording medium is thin, so that the degree of deformation by the swelling and shrinkage of the recording medium becomes great. As described above, it has been found that cockling cannot be effectively inhibited in recording media low in basis weight and recording media thin in thickness according to the conventional methods.

(2) When the surface of a recording medium has been smoothed by a calendering treatment, the occurrence of cockling has markedly increased. This is attributable to the circumstance that the properties (three-dimensional configuration of cellulose fiber, pore structure between cellulose fibers, etc.), and the like of cellulose making up the recording medium are changed by the smoothing treatment. As described above, it has been found that the occurrence of cockling increases when the surface of the recording medium is smoothed for improving image quality, and any recording medium capable of attaining both improvement of image quality and inhibition of occurrence of cockling at the same time cannot be provided.

(3) When an ink-receiving layer has been formed on a recording medium, in which the underwater elongation of base paper has been controlled like Japanese Patent Application Laid-Open Nos. H03-199081 and H08-300809, the cockling phenomenon caused by ink has become marked compared with a recording medium on which no ink-receiving layer has been formed. This is attributable to the circumstance that the underwater elongation cannot be controlled due to absorption and drying of water in the recording medium in a step of forming the ink-receiving layer. As a result, it has been found that when an ink-receiving layer is formed, cockling may not be inhibited in some cases even when the underwater elongation has been controlled in a papermaking step.

Further, the present inventor has found that when an image is formed while increasing the amount of an ink applied to a recording medium to 2 times or 3 times, the ink-absorbing capacity of the recording medium itself is lowered, ink overflowing and/or bleeding may be caused in some cases to fail to achieve good image quality.

It has also been confirmed that when an image is formed on various kinds of the recording media proposed in the prior art documents by a printer for conducting high-speed printing in recent years, it is not always satisfactory from the viewpoints of image quality, surface gross, curling, cockling, paper conveyability and the like.

The phenomena of curling and cockling are both considered to be caused by occurrence of expansion and contraction and/or distortion in a recording medium by ink absorption. The cause of these phenomena will hereinafter be described in detail. A condition where cellulose has been dispersed in a beating liquid after pulp used in a conventional recording medium has been beaten is illustrated in FIG. 3A. When the pulp is beaten, the fiber length of cellulose 22 making up the pulp is shortened as shown in FIG. 3A, and at the same time fibrillation (to cause branching of fiber) progresses, so that a great number of branches 21 are produced to increase the surface area of the cellulose.

Then, a condition where paper has been made with the cellulose after the beating to produce a recording medium is illustrated in FIG. 3B. Incidentally, FIG. 3B partially shows a microstructure of the recording medium. Since the cellulose 22 has a large surface area, hydrogen bonds (indicated by a dotted line) are formed at many positions. As a result, the volume of pores in the interior of the recording medium decreases to provide a recording medium high in density.

When printing is then conducted on this recording medium, an ink component is absorbed in the interior of cellulose and between cellulose fibers. As a result, the hydrogen bonds formed at many positions between cellulose fibers are cleaved by water and a hydrophilic component 23 contained in the ink as illustrated in FIG. 4A. The cellulose itself is also deformed by absorption of water and the like.

When the recording medium, in which the ink has been absorbed, is then dried, water and the hydrophilic component bonded to the cellulose are removed, and hydrogen bonds are formed again between the cellulose fibers. At this time, the cleavage (FIG. 4A) of the hydrogen bonds formed between the cellulose fibers by the ink absorption and the formation (FIG. 4B) of the hydrogen bonds between the cellulose fibers by the drying are not conducted at exactly the same positions (hydrogen bonds are formed at positions different from the positions where the original hydrogen bonds have been formed). Therefore, the recording media shown in FIGS. 4B and 3B are different in positions of the hydrogen bonds have been formed, and thus both recording media have different spatial configurations from each other. The cause of this is considered to be attributable to the circumstance that evaporation of ink components upon the drying is not conducted completely evenly at all portions within the recording medium, and that the cellulose itself is deformed by the ink absorption. Such a phenomenon is considered to appear as a cockling phenomenon as the whole of the recording medium.

The present inventor has thus carried out an extensive investigation. As a result, it has been discovered that there is a need to produce a recording medium having the following properties for solving such problems as described above:

(a) being high in the stiffness of fibers making up the recording medium, and little in deformation attendant on the absorption and drying of ink; and (b) being not changed in the relative spatial configuration of the fibers making up the recording medium upon the absorption and drying of ink, calendering or the like (having no change in the pore structure between fibers).

The present inventor has found that in order for the resulting recording medium to have the above-described properties (a) and (b), it is only necessary to use cellulose subjected to a particular treatment and to fill a porous filler into pores formed by making the density of a porous cellulose layer formed of this cellulose low.

The present inventor has further found that the porous filler is filled into the pores in a particular filled state, whereby deformation of the cellulose attending on the absorption and drying of the ink or calendering is effectively assimilated within voids formed between particles of the porous filler to more hardly cause curling, cockling and the like.

In other words, the present invention has the following objects.

It is a first object of the present invention to provide a recording medium, which has the above-described constitution, and is good in ink absorbency and little in the frequency of occurrence of cockling even when the recording medium is composed of a thin paper having a thickness of 150 μm or smaller.

A second object of the present invention is to provide a recording medium, which is free from ink overflowing, provides images high in density and bright or vivid in color tone and inhibits cockling even when the surface of the recording medium is subjected to a smoothing treatment.

A third object of the present invention is to provide a recording medium, which does not increase the frequency of occurrence of cockling even when an ink-receiving layer is provided on a substrate, compared with a recording medium comprising no ink-receiving layer provided on the substrate.

SUMMARY OF THE INVENTION

The above objects are achieved by the present invention described below.

In a first aspect of the present invention, there is thus provided a recording medium comprising a porous cellulose layer containing at least one cellulose selected from the group consisting of lightly-beaten cellulose pulp, mercerized cellulose and fluffed cellulose and a porous filler internally loaded therein.

In a second aspect of the present invention, there is also provided a recording medium comprising a substrate and an ink-receiving layer provided on the substrate, wherein the substrate comprises a porous cellulose layer containing at least one cellulose selected from the group consisting of lightly-beaten cellulose pulp, mercerized cellulose and fluffed cellulose and a porous filler internally loaded therein.

In the recording media, the porous filler may preferably be distributed in a in-plane direction of the recording medium. In the recording media, the porous filler may preferably be internally loaded in such a manner that each particle of the porous filler comes into contact with one fiber of the cellulose or comes into no contact with any fiber of the cellulose.

In the recording media, the density of the porous cellulose layer may preferably be 0.7 g/cm$^3$ or lower.

In the recording media, the porous filler may preferably be at least one of silica and silicate.

In the recording media, the content of the porous filler in the porous cellulose layer may preferably be 5% by mass or higher and 20% by mass or lower in terms of ash content.

In the recording media, the average particle diameter of the porous filler may preferably be 1 μm or larger and 4 μm or smaller and be smaller than the average pore diameter of the porous cellulose layer.

In the present invention, the recording media may preferably be recording media for ink-jet recording.

In a further aspect of the present invention, there is provided an image forming process comprising applying droplets of an ink to one surface of a recording medium to conduct printing, wherein the recording medium described above is used as the recording medium.

In the image forming process, the application of the droplets of the ink to one surface of the recording medium may preferably be conducted by an ink-jet method in which fine droplets of an ink are ejected from nozzles of an ink-jet recording head having a nozzle line to apply them to a recording medium.

Typical effects brought about by the invention described above are as follows.

(1) According to an embodiment of the present invention, the recording medium is good in ink absorbency and little in the frequency of occurrence of cockling even when the recording medium is as thin as 150 μm or smaller. In addition, the recording medium is little in the frequency of occurrence of cockling after printing, good in ink absorbency and does not cause strike-through on a printed area even when printing is conducted in an ink quantity exceeding ordinary 100%. Further, the recording medium can inhibit its rapid deformation right after printing because elongation of the recording medium right after the printing can be lessened.

(2) According to another embodiment of the present invention, the recording medium is free from ink overflowing and can provides images high in density and bright or vivid in color tone even when the surface of the recording medium is subjected to a smoothing treatment.

(3) According to a further embodiment of the present invention, the recording medium does not increase the frequency of occurrence of cockling even when an ink-receiving layer is provided on a substrate, compared with a recording medium having no ink-receiving layer on the substrate.

DETAILED DESCRIPTION OF THE INVENTION

Recording Medium

Figure 1:
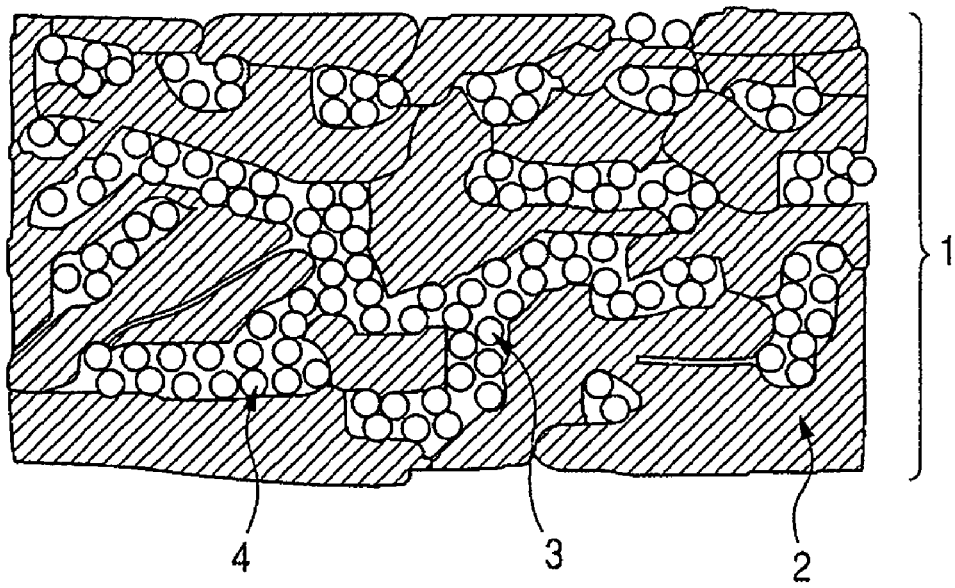
FIG. 1 is a cross-sectional view illustrating a recording medium according to the present invention.

The present invention will hereinafter be described in more detail by preferred embodiments. The present inventor has carried out various investigations with a view toward preventing deformation and cockling caused by shooting of ink for recording media composed of a substrate alone and recording media composed of a substrate and an ink-receiving layer.

As a result, it has been found that the occurrence of cockling can be reduced by providing a recording medium with the constitution where a porous filler is internally loaded in a low-density porous cellulose layer or a recording medium with the constitution where an ink-receiving layer is provided on a substrate composed of a low-density porous cellulose layer in which a porous filler is internally loaded, thus leading to completion of the present invention.

Incidentally, the term "internal loading" means that the porous filler is distributed in both in-plane and thickness-wise directions of the recording medium. The term "the porous filler is distributed in the thickness-wise direction" means the porous filler is present in pores between cellulose fibers over the whole of the thickness-wise direction of the porous cellulose layer. For example, a condition where the porous filler is present only in the vicinity of the surface of the recording medium is not included in "internal loading".

In particular, even in a recording medium as thin as 150 μm or smaller, or a recording medium the surface of which has been smoothed by a calendering treatment, the occurrence of cockling can be effectively inhibited by providing a recording medium of the constitution according to the present invention. In the constitution where an ink-receiving layer is provided on a substrate, it has particularly been found that increase in the frequency of occurrence of cockling caused by the formation of the ink-receiving layer can be reduced.

The recording media according to the present invention comprise a porous cellulose layer containing at least one cellulose selected from the group consisting of lightly-beaten cellulose pulp, mercerized cellulose and fluffed cellulose and a porous filler internally loaded in the porous cellulose layer. The recording media according to the present invention may be composed of only the porous cellulose layer in which the porous filler is internally loaded or a substrate composed of the porous cellulose layer in which the porous filler is internally loaded, and an ink-receiving layer provided on the substrate. In recording media according to the present invention, a back coat layer may also be provided on one surface (in the case where the recording medium has a substrate and an ink-receiving layer, a surface opposite to a surface, on which the ink-receiving layer is provided) of the porous cellulose layer. The back coat layer has functions of preventing the occurrence of curling and well retaining printability. This back coat layer can be formed from, for example, a layer containing alumina. As examples of alumina, may be mentioned boehmite, pseudoboehmite, γ-alumina and θ-alumina. However, the present invention is not limited to them. Incidentally, in the recording media according to the present invention, cockling, curling and the like can be effectively inhibited upon the formation of the layer like the case where the ink-receiving layer is provided even when the back coat layer is formed.

The porous cellulose layer making up the recording media according to the present invention is made porous by making the density thereof low and forming a great number of pores between cellulose fibers forming the porous cellulose layer.

FIG. 1 is a cross-sectional view illustrating an recording medium according to an embodiment of the present invention. As illustrated in FIG. 1, the recording medium according to the present invention is composed of a porous cellulose layer 1 comprising cellulose 2 (at least one of lightly-beaten cellulose pulp, mercerized cellulose and fluffed cellulose) as a main component. Pores 3 are present between fibers of the cellulose 2, and a porous filler 4 is present in the pores 3. The porous filler 4 is present in such a state that voids have been partially left within the pores 3. The porous filler 4 is filled in such a state that each particle thereof comes into contact with one cellulose fiber or comes into no contact with any cellulose fiber.

Figure 2:
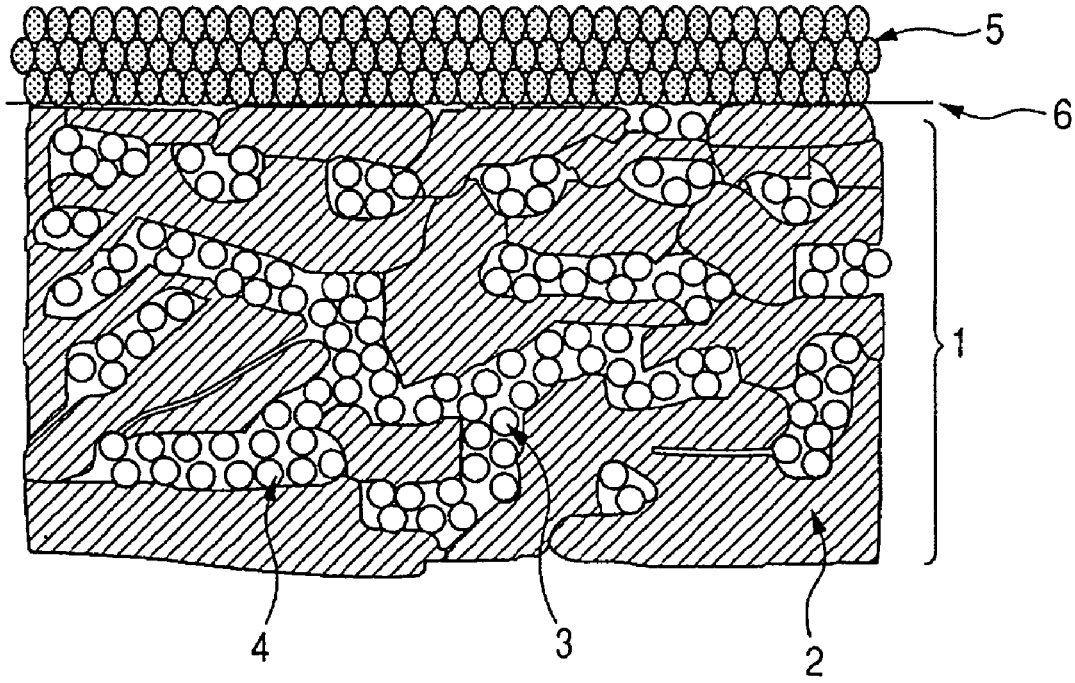
FIG. 2 is a cross-sectional view illustrating a recording medium according to the present invention.
Figure 3B:
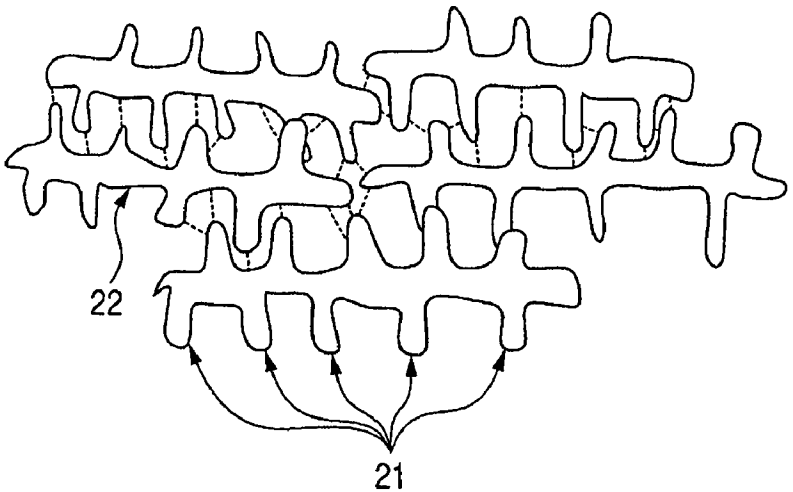
FIGS. 3A and 3B are a cross-sectional views illustrating a conventional recording medium in the course of production.
Figure 3A:
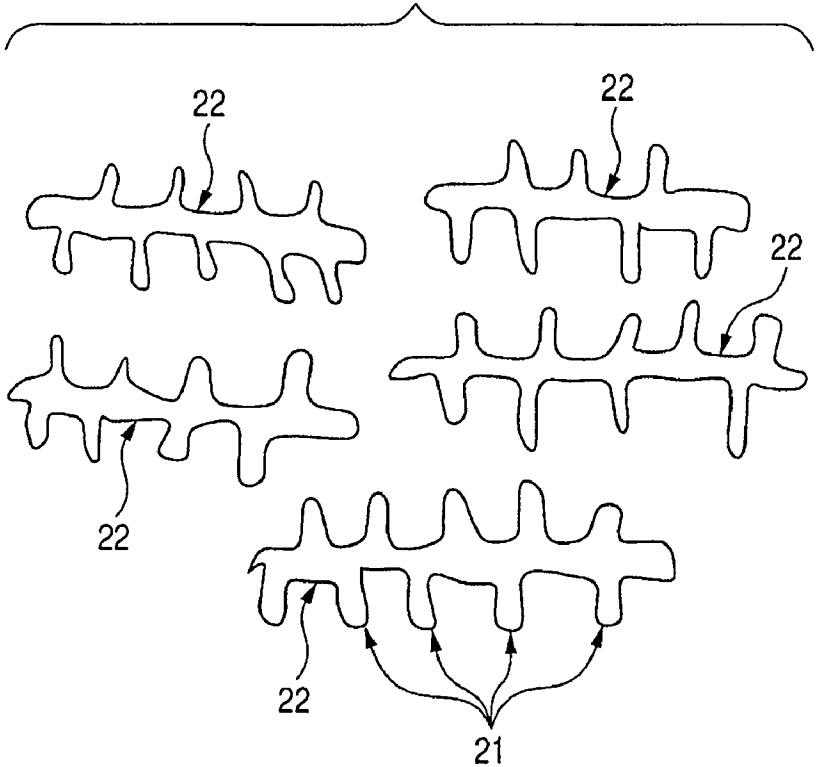
Figure 4B:
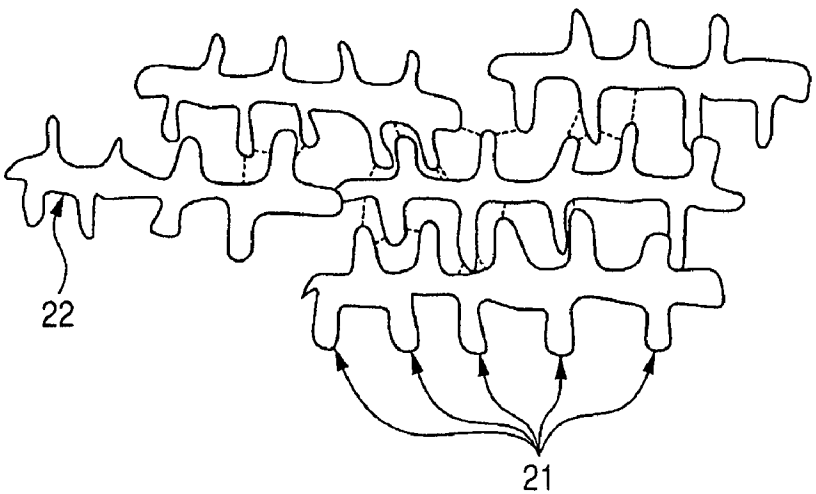
FIGS. 4A and 4B are a cross-sectional views illustrating a conventional recording medium in the course of production.
Figure 4A:
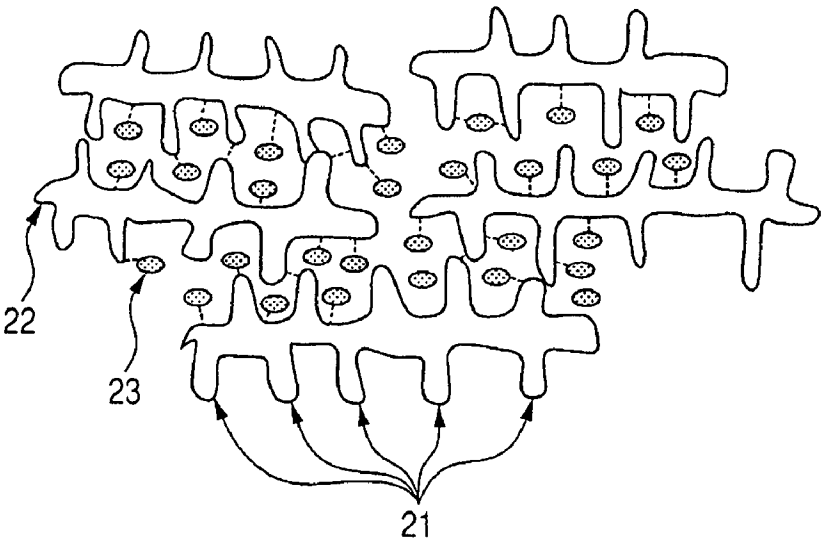

FIG. 2 is a cross-sectional view illustrating an recording medium according to another embodiment of the present invention. As illustrated in FIG. 2, the recording medium has such a structure that an ink-receiving layer 5 is formed on a substrate 1 composed of a porous cellulose layer in which a porous filler 4 has been internally loaded. A boundary part 6 is present at an interface between the substrate 1 and the ink-receiving layer 5. The boundary part 6 can be clearly distinguished by an electron microphotograph or the like. The ink-receiving layer 5 is formed by a porous inorganic pigment.

As illustrated in FIGS. 1 and 2, in an embodiment of the present invention, the pores 3 are present between fibers of the cellulose 2 forming the substrate 1. The porous filler 4 is filled into each of the pores 3 in such a state that each particle thereof comes into contact with one cellulose fiber or comes into no contact with any cellulose fiber. Voids, which are not completely filled by the porous filler 4, are present within the pores 3.

(Effects)

The recording media according to the present invention are considered to have the following effects. The cellulose 2 forming the porous cellulose layer generally swells when an ink is absorbed therein, and then causes shrinkage. In this case, when the porous filler 4 having a large specific surface area is present in the pores 3 between fibers of the cellulose, an ink component penetrated into the porous cellulose layer 1 is absorbed in the porous filler 4 before being absorbed in the cellulose 2. Thereafter, the ink component diffuses in the whole (cellulose 2 and the like) of the porous cellulose layer 1. At this time, deformation by swelling of the cellulose 2 can be effectively inhibited because the porous filler is present throughout the thickness-wise direction of the porous cellulose layer according to the present invention.

Even if the cellulose absorbs the ink and swells, the pore structure formed between the cellulose fibers can be retained because the porous filler 4 having a high hardness is present within the pores 3 between the fibers of the cellulose 2, so that the deformation of the porous cellulose layer 1 can be inhibited.

Further, the porous filler 4 having a high hardness is present within the pores 3, the relative three-dimensional configuration of the cellulose fibers can be retained. As a result, the cleavage and formation of hydrogen bonds between the fibers of the cellulose 2 attending on ink absorption and drying can be effectively inhibited.

In the recording media according to the present invention, it is considered that deformation attendant on the ink absorption can be inhibited by such effects as described above.

In the recording media according to the present invention, it is particularly preferred that the porous cellulose layer 1 be low in density, and that large pores having an average pore diameter of 5 μm or larger and 10 μm or smaller be formed therein. The porous filler 4 preferably has an average particle diameter of 1 μm or larger and 4 μm or smaller and is preferably filled into the pores formed between fibers of the cellulose 2 in such a manner that a plurality of filler particles lie one on top of another. The average particle diameter of the porous filler 4 falls within this range, whereby the porous filler 4 can be effectively filled into the pores between the cellulose fibers to more effectively retain the three-dimensional configuration of the cellulose fibers.

The effects of the recording media according to the present invention will hereinafter be described in more detail.

(1) Preventive Effect on Cockling or the Like of the Recording Medium Small in Thickness:

In the recording medium particularly thin in thickness as 150 μm or smaller, the amount of cellulose making up the recording medium is small. Therefore, the expansion and contraction and the change in three-dimensional configuration of the cellulose attending on ink absorption markedly appear as cockling, curling and/or the like. However, in the recording medium according to the present invention, the stiffness of the cellulose fibers forming the porous cellulose layer is high, and the porous filler is contained in the pores between the cellulose fibers, so that the three-dimensional configuration of the cellulose fibers is hard to be changed. Therefore, the occurrence of cockling, curling or the like attending on the ink absorption can be effectively prevented even when the thickness of the recording medium is small.

(2) Preventive Effect on Cockling or the Like Upon Calendering Treatment:

When a recording medium is subjected to a calendering treatment, the cellulose 2 making up the substrate 1 is deformed by pressure upon the calendering treatment. At this time, the pores 3 between fibers of the cellulose 2 are unevenly collapsed from portions weak in mechanical strength in the cellulose forming the pores and made small. However, in the recording medium according to the present invention, the porous filler 4 having a high hardness is present in the pores 3 between fibers of the cellulose, so that the pores 3 are hard to cause volumetric change. In addition, since the mechanical strength of the cellulose become uniform, the whole of the recording medium can be uniformly pressurized upon calendering to prevent the pressure from concentrating on particular portions to ununiformly collapse the pores.

In addition to the above effects, the surface of the cellulose 2 can be covered with the porous filler 4 when the amount of the porous filler 4 added is great, so that variations of surface profile in respective fibers of the cellulose 2 can be corrected to make surface properties uniform. As a result, the ink absorbency can be made uniform to uniformly diffuse ink absorbed in the substrate 1. In addition, ink can be absorbed in the internal pores of the porous filler 4 and voids formed between particles of the porous filler 4 to improve the ink absorbency of the recording medium.

(3) Preventive Effect on Cockling or the Like of the Recording Medium Having an Ink-Receiving Layer:

In the case of a recording medium with the ink-receiving layer 5 formed on the substrate 1, the recording medium can be produced by applying an aqueous liquid dispersion of materials for forming the ink-receiving layer 5 on to the substrate 1 and drying it. At this time, water in the aqueous liquid dispersion applied penetrates into the substrate 1. The cellulose 2 making up the substrate 1 is expanded and contracted by the water penetrated. However, in the recording medium according to the present invention, the porous filler is present in the pores 3 between the fibers of the cellulose 2. Therefore, the shrinkage of the cellulose 2 in the drying step is reduced to the same degree as the shrinkage of the ink-receiving layer. As a result, stress (strain) upon drying is not left in the substrate 1, on which the ink-receiving layer 5 has been formed. When printing is conducted on the recording medium, the cellulose 2 in the substrate 1 is expanded and contracted by an ink absorbed. However, the recording medium returns to the stable form before the printing and is hard to cause deformation.

As described above, it is considered that the respective effects of improvement in ink absorbency, prevention of cockling and prevention of strike-through in the present invention are developed by any combination of these constitutions. Incidentally, in the present invention, the porous cellulose layer has a low density, and the porous filler is filled into the pores, and so the three-dimensional configuration of the cellulose fibers is hard to be changed. The stiffness of the cellulose forming the porous cellulose layer is also high. Therefore, the recording media according to the present invention have all properties necessary for practical use, such as mechanical strength.

In the recording medium, deformation of cellulose fibers attendant on the absorption and drying of ink, calendering or the like can be effectively inhibited by filling the porous filler into the pores to retain the relative spatial configuration of the cellulose fibers. However, it may be preferable in some cases to permit the deformation of the cellulose fibers to some extent while retaining the basic spatial configuration of the cellulose fibers, because internal stress is not generated in the interiors of the cellulose fibers. Accordingly, in a further embodiment of the present invention, the porous filler is filled into the pores (pores formed between the cellulose fibers) in a special filled state, whereby the deformation of the cellulose fibers can be made possible to some extent. As a result, internal stress can be made harder to remain in the interiors of the cellulose fibers.

This recording medium is characterized by the filled state of the porous filler, and each particle of the porous filler filled into the pores comes into contact with one cellulose fiber or comes into no contact with any cellulose fiber. The filled state of the porous filler will hereinafter be described in more detail with reference to FIGS. 5A to 7B.

Figure 6A:
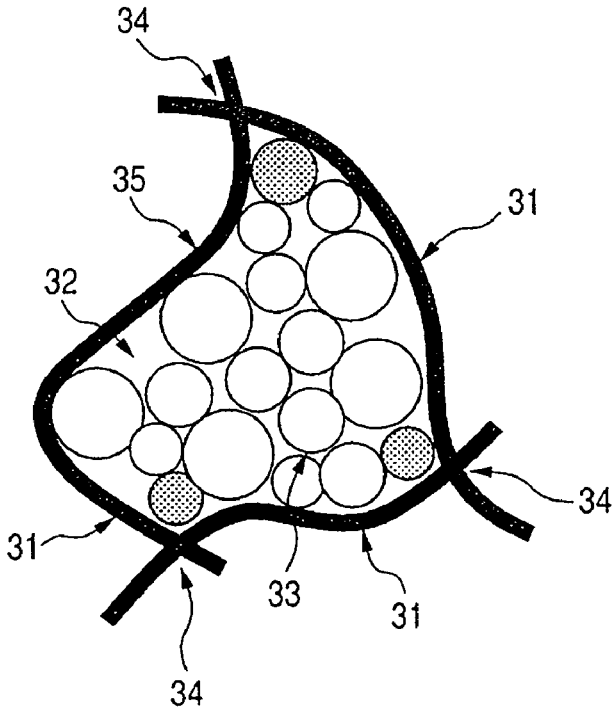
FIGS. 6A and 6B illustrate an example of a condition where a porous filler has been filled in a recording medium according to the present invention.
Figure 6B:
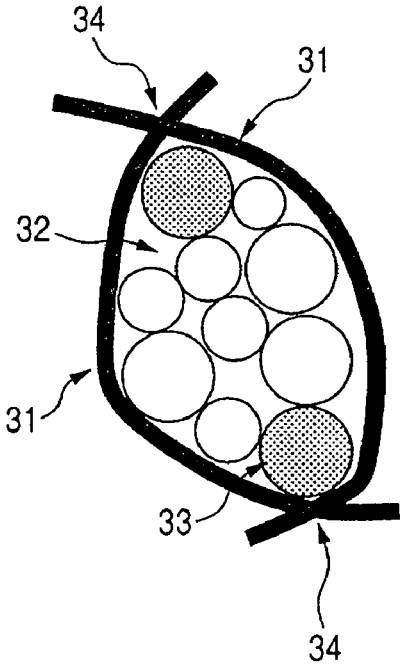

FIGS. 6A and 6B illustrate a state where a porous filler 33 has been filled in such a manner that part of the porous filler 33 (particles indicated by a gray color) filled into a pore 32 formed by cellulose fibers 31 comes into contact with two cellulose fibers at an intersection 34 between the cellulose fibers. FIG. 6A illustrates a state where the pore 32 has been formed by three cellulose fibers, and FIG. 6B illustrates a state where the pore 32 has been formed by two cellulose fibers. When the average particle diameter of the porous filler is considerably smaller than the average pore diameter in the porous cellulose layer, such a filled state is created. The porous filler is filled at the intersection 34 between the cellulose fibers in this manner and comes into contact with two cellulose fibers, whereby the cellulose fibers come to be fixed at the intersection. The cellulose fibers are also fixed at other portions than the intersection between the cellulose fibers by filling the porous filler. Accordingly, the cellulose fibers cannot be deformed upon the absorption and drying of ink, calendering or the like and fixed as they are. As a result, internal stress may partially remain in the cellulose fibers in some cases.

Figure 7A:
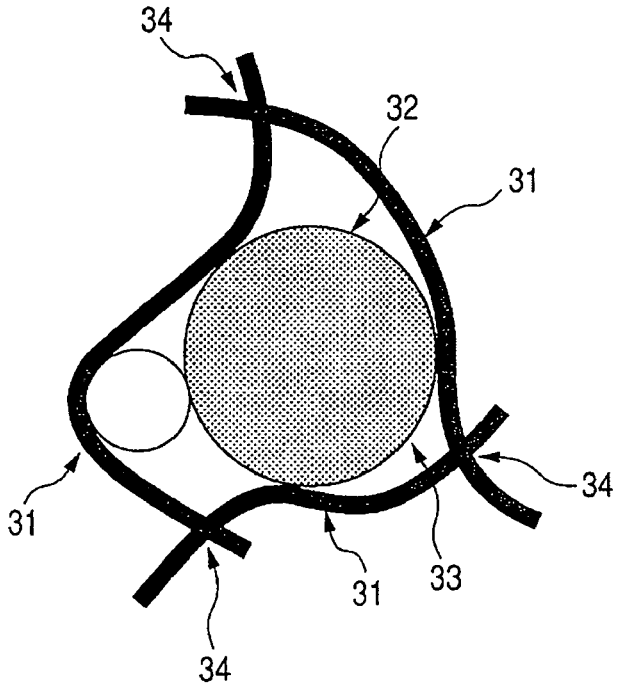
FIGS. 7A and 7B illustrate another example of a condition where a porous filler has been filled in a recording medium according to the present invention.
Figure 7B:
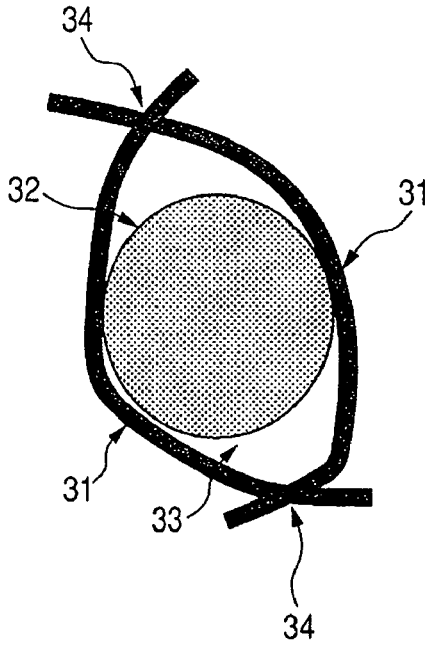

Like FIGS. 6A and 6B, FIGS. 7A and 7B also illustrate a state where a porous filler 33 has been filled into a pore 32 in such a manner that part of the porous filler 33 (particle indicated by a gray color) comes into contact with two cellulose fibers. However, the porous filler shown in FIGS. 7A and 7B has a greater average particle diameter than the porous filler shown in FIGS. 6A and 6B. FIGS. 7A and 7B are different from FIGS. 6A and 6B in that the porous filler comes into contact with two cellulose fibers at other portions than the intersection 34 in the pore. In the case of such a filled state, a considerable portion within the pore is occupied by the porous filler though the porous filler comes into no contact with the intersection. Therefore, void portions capable of absorbing the deformation of the cellulose fibers attending on the absorption and drying of ink, calendering or the like are little in the pore. Considerable portions of the two cellulose fibers come into contact with a particle of the porous filler, and the portions of the cellulose fibers, with which the porous filler particle has come into contact, are completely fixed. Accordingly, in the case of FIGS. 7A 7B, the cellulose fibers can also not be deformed upon the absorption and drying of ink, calendering or the like and fixed like FIGS. 6A and 6B. As a result, internal stress may partially remain in the cellulose fibers in some cases. Incidentally, FIGS. 6A and 6B and FIGS. 7A and 7B illustrate the case where the porous filler comes into contact with two cellulose fibers. However, a case where the porous filler comes into contact with at least three cellulose fibers may also cause the same problem in some cases.

Figure 5A:
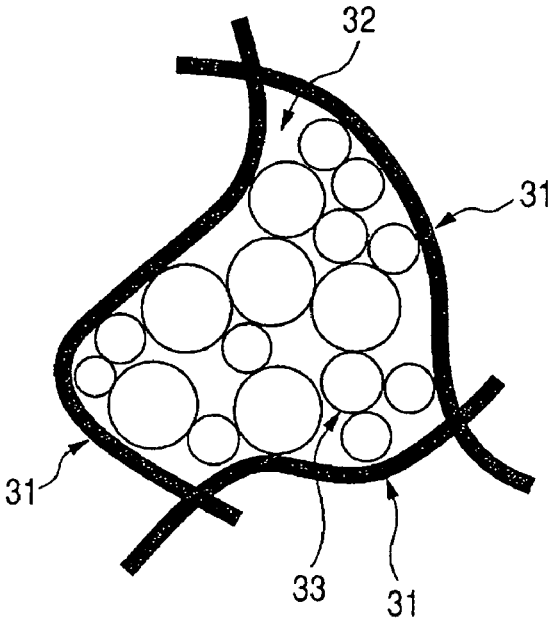
FIGS. 5A and 5B illustrate an example of a condition where a porous filler has been filled in a recording medium according to the present invention.
Figure 5B:
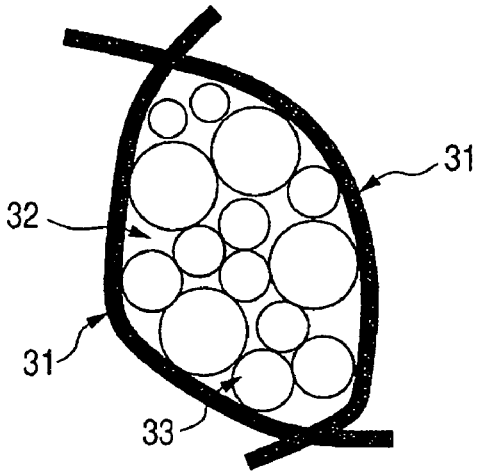

By contrast, the porous filler is filled into pores in FIGS. 5A and 5B in such a manner that each particle of the porous filler comes into contact with one cellulose fiber or comes into no contact with any cellulose fiber. In such a filled state, intersections between cellulose fibers are not fixed by the porous filler. Any portion where at least two fibers are completely fixed by one particle of the porous filler does not exist. Therefore, the cellulose fibers can be deformed to some extent upon the absorption and drying of ink, calendering or the like, and the basic spatial configuration of the cellulose fibers is retained by filling the porous filler into the pores. This deformation of the cellulose fibers can be fully absorbed in voids formed between particles of the porous filler. Accordingly, internal stress is hard to remain within the cellulose fibers.

Incidentally, in the filled state in this embodiment, it is only necessary that the porous filler comes into no contact with any cellulose fiber or comes into contact with only one cellulose fiber (the number of cellulose fibers coming into contact with the porous filler is 0 or 1). In any case, a porous filler particle may or may not come into contact with other porous filler particles. In this case, the number of other porous filler particles coming into contact with such a porous filler particle may be 1, or 2 or more. The pore may also be formed by four or more cellulose fibers. In the recording medium according to this embodiment, the porous filler is filled in such a state as described above throughout the thickness-wise direction such as the vicinity of the surface thereof and the interior thereof. This filled state remains unchanged even when an ink-receiving layer is formed or not formed on the porous cellulose layer.

The filled state of the porous filler into the pore can be observed in accordance with the following procedure.

(I) A recording medium is slowly cut by hand using a microtome to provide 10 samples.

(II) An arbitrary portion of the cut surface in each sample provided in (I) is photographed at 5,000 magnifications through a scanning electron microscope (S4000 (trade name), manufactured by Hitachi Ltd.).

(III) With respect to the photograph taken, a boundary between the porous filler particles and the cellulose fibers is distinguished in accordance with a method of two-dimensional image analysis by means of an image analyzer (LUZEX AP (trade name), manufactured by NICOLET CO.).

(IV) Whether porous filler particles and cellulose fibers in the photograph come into contact with each other or not is judged on the basis of the boundary distinguished in (III).

Incidentally, it has been found by a preliminary experiment that when observation is made in such procedure, the filled state of the porous filler is not changed upon the preparation of the samples for observation, and the filled state of the porous filler can be exactly confirmed.

When the filled state of the porous filler is observed by the above-described method, a porous filler particle (porous filler particle which apparently looks floating) coming into contact with neither a cellulose fiber nor a porous filler particle may be observed in some cases according to the portion photographed through the scanning electron microscope. For reasons why such a porous filler particle is observed, are considered a case where such a fine particle as not to be taken in the scanning electron microphotograph supports the porous filler particle, or a case where another porous filler particle or the like is present at the rear of the porous filler particle in the photograph at such an arrangement as not to be taken in the scanning electron microphotograph, and this supports the porous filler particle in the photograph. In the present specification, such a porous filler particle is also included in the porous filler particle "coming into contact with one cellulose fiber or coming into no contact with any cellulose fiber".

In the recording media according to the present invention, all porous filler particles distinguished by the procedure of (I) to (IV) preferably come into contact with one cellulose fiber or come into no contact with any cellulose fiber. Even when at least 90% (by number), typically at least 95% (by number) of the porous filler particles observed by the above procedure come into contact with one cellulose fiber or come into no contact with any cellulose fiber, the effects of the present invention can be exhibited.

The respective components and the like of the recording media according to the present invention will hereinafter be described in more detail.

(Components of Porous Cellulose Layer)

The recording media according to the present invention comprise a porous cellulose layer containing at least one cellulose selected from the group consisting of lightly-beaten cellulose pulp, mercerized cellulose and fluffed cellulose, and a porous filler internally loaded in the porous cellulose layer. The porous cellulose layer is a sheet-like medium, and the porous filler is present in pores between cellulose fibers making up the porous cellulose layer. The respective components making up the recording media will hereinafter be described.

In the present invention, particular cellulose is used, thereby ensuring pore volume between the cellulose fibers, and the porous filler is filled into such pores, whereby the stiffness of the porous cellulose layer can be enhanced to lessen cockling. In addition, the ink-absorbing rate and ink-absorbing capacity of the resulting recording medium can be improved. The density of cellulose pulp can be measured in accordance with the method described in Japanese Patent Application Laid-Open No. 2004-066492.

(1) Lightly-Beaten Cellulose Pulp:

In the present invention, the rightly-beaten cellulose pulp means cellulose pulp, in which no fibril is substantially observed on the surfaces of cellulose fibers when it is observed at 500 magnifications through a scanning electron microscope. The lightly-beaten cellulose pulp means a pulp having a low degree of beating obtained by slightly beating chemical pulp mainly made from chip of wood or the like. Such lightly-beaten cellulose pulp is used, whereby the number of hydrogen bonds formed in cellulose fibers can be lessened, so that the density of the porous cellulose layer after a calendering treatment can be reduced to a low density of 0.7 g/cm$^3$ or lower. In addition, since portions, at which a hydrogen bond is irreversibly formed with the absorption and drying of ink, are small, cockling can be effectively inhibited.

As the lightly-beaten cellulose pulp, pulp having a Canadian standard freeness of at least 500 ml is preferred, and pulp having a Canadian standard freeness of at least 550 ml is more preferred. When the degree of beating falls within this range, the stiffness of the cellulose pulp is maintained, and moreover the density of the substrate can be controlled to a density still lower than 0.7 g/cm$^3$ (after the calendering treatment). The amount of the porous filler internally loaded can be increased to 20% by mass in terms of ash content and the inhibitory effect on cockling can be enhanced. A pulp having a Canadian standard freeness of at least 600 ml is still more preferred. When the degree of beating falls within this range, the density of the substrate can be controlled to a still lower density, and moreover the pores between cellulose fibers making up the porous cellulose layer can be enlarged. Therefore, the porous filler can be internally loaded in such a state that large voids are left between filler particles.

Incidentally, the lightly-beaten cellulose pulp may be treated to provide mercerized cellulose or fluffed cellulose. When the porous cellulose layer according to the present invention contains the lightly-beaten cellulose pulp, it is only necessary for at least one of cellulose pulp contained in the porous cellulose layer to be the lightly-beaten cellulose pulp.

(2) Mercerized Cellulose:

In the present invention, the mercerized cellulose means a cellulose obtained by treating raw pulp in an aqueous alkali solution, in which the proportion of cellulose II (hydrated cellulose) in the cellulose is enhanced. The cellulose II is one of the crystal structures of cellulose. The mercerized cellulose is used, whereby the density of the resulting recording medium can be made lower than the use of natural cellulose to internally load the porous filler. Since stiffness is imparted to the mercerized cellulose by change of the crystal structure, the cellulose is hard to be deformed even when ink is absorbed.

The mercerization can be conducted in accordance with any publicly known method. Mercerizing methods are described in, for example, "Pulping Processes" edited by Rydholm (Interscience Publishers, 1965) and "Cellulose and Cellulose Derivatives" edited by Ott, Spurlin and Grafflin, Vol. V, Part 1 (Interscience Publishers, 1954), and these methods may be used.

As the aqueous alkali solution, may be used, for example, an aqueous solution of an alkali metal hydroxide, such as an aqueous solution of sodium hydroxide (NaOH), an aqueous solution of lithium hydroxide (LiOH), an aqueous solution of potassium hydroxide (KOH) or an aqueous solution of rubidium hydroxide (RbOH), or an aqueous solution of benzyltrimethylammonium hydroxide (BTMOH).

The mercerized cellulose used in the present invention is preferably that treated in such a manner that the content of cellulose II is from 80% by mass to 100% by mass. When the content of cellulose II falls within this range, the size of pores formed between cellulose fibers can be made large while retaining the stiffness of the cellulose, and so the porous filler can be effectively internally loaded into the porous cellulose layer. Incidentally, the content of the cellulose II can be determined in accordance with the method described in Japanese Patent Application Laid-Open No. 2003-293284.

(3) Fluffed Cellulose:

In the present invention, the fluffed cellulose means a cellulose obtained by adding a crosslinking agent to raw cellulose pulp, conducting mechanical agitation for deforming cellulose to fluff the cellulose, and then conducting a heat treatment to fix the deformation of the cellulose.

Since cellulose fibers in the fluffed cellulose are fixed to each other by crosslinking, the cellulose fibers and the three-dimensional configuration of the cellulose fibers are hard to be deformed. In addition, since the cellulose fibers are fixed by the mechanical agitation so as to have large pores in the interior thereof, the density of the porous cellulose layer can be lowered.

This mechanical agitation is conducted for imparting deformation such as curling or twisting to the cellulose to accelerate crosslinking between cellulose fibers. A disk refiner, kneader, disperser or the like may be used for the mechanical agitation. The crosslinking reaction between the crosslinking agent added and the cellulose fibers is accelerated by the heat treatment to fix the deformation such as curling or twisting, which has been imparted by the mechanical agitation.

As the crosslinking agent, may be widely used publicly known agents. As examples thereof, may be mentioned formalin-containing crosslinking agents such as formaldehyde, urea-formalin resins and melamine-urea-formalin resins; bifunctional aldehyde crosslinking agents such as glyoxal and dialdehyde compounds; polycarboxylic acid crosslinking agents; and ethyleneurea crosslinking agents. A crosslinking agent may be suitably selected from among these to use it. The amount of the crosslinking agent added varies according to the nature of the crosslinking agent used and its reactivity with the cellulose. However, it is preferably within a range of from 1 to 10% by weight in terms of solid content based on the absolute dry weight of the cellulose.

The curl factor of the resultant fluffed cellulose is preferably from 0.4 to 1.0. When the curl factor falls within this range, a space between the cellulose fibers can be taken widely, and the stiffness of the cellulose can be enhanced. Entanglement of cellulose fibers in the porous cellulose layer is easy to occur. As a fluffing method and a measuring method of the curl factor, may be used the respective methods described in Japanese Patent Application Laid-Open Nos. H08-000667 and H11-229289, and the like.

Incidentally, the cellulose used in the present invention may contain the lightly-beaten cellulose pulp, mercerized cellulose and fluffed cellulose at the same time. For example, that obtained by fluffing the mercerized cellulose, that obtained by mercerizing the lightly-beaten cellulose pulp, that obtained by fluffing the lightly-beaten cellulose pulp, or that obtained by mercerizing and fluffing the lightly-beaten cellulose pulp may also be used.

(4) Pulp:

As pulp or lightly-beaten cellulose pulp for cellulose (mercerized cellulose and/or fluffed cellulose) making up the porous cellulose layer of the recording media according to the present invention, one kind of pulp may be used, or plural kinds of pulp may be used in combination as needed. Examples of usable pulp include chemical pulp obtained from deciduous and coniferous trees, such as sulfite pulp (SP), alkaline pulp (AP) and kraft pulp (KP), semichemical pulp, semimechanical pulp, mechanical pulp, and waste paper pulp that is composed of deinked secondary fibers. The pulp may be used without distinction of unbleached pulp or bleached pulp, and beating or unbeating.

As described above, may also be used fibers of grass, leaves, bast, seed hair and the like, for example, pulp from straw, bamboo, hemp, bagasse, kenaf, camellia, *Edgeworthia papyrifera*, cotton linter and the like. In the present invention, the density of the porous cellulose layer after a calendering treatment is at most 0.7 g/cm$^3$ for inhibiting cockling. Incidentally, the density can be reduced to 0.7 g/cm$^3$ or lower by controlling conditions for beating treatment of the pulp and the amount of the pulp added.

In the recording media according to the present invention, at least one selected from the group consisting of finely fibrillated cellulose, crystallized cellulose, sulfate pulp making use of deciduous or coniferous trees as a raw material, sulfite pulp, soda pulp, hemicellulase-treated pulp and enzyme-treated chemical pulp may be added for use in addition to the above-described pulp. The addition of such pulp brings about such an effect that the smoothness and formation of the resulting recording medium are improved.

In the present invention, that of either a single-layer structure or a multi-layer structure may be used as the porous cellulose layer of the recording medium without a particular limitation.

(5) Porous Filler:

The porous filler used in the present invention is in the form of secondary particles obtained by bonding primary particles to each other. As the form of the porous particles, may be used various kinds of forms such as a sphere, a massive form and a needle. The specific surface area of the porous filler is preferably 50 m$^2$/g or higher for making interaction with the cellulose fibers small. As the porous filler, any filler may be used without a limitation so far as it is porous. A preferred filler is a silica filler such as silica or silicate. These porous fillers are easy to control their pore structures and moreover have a high ink-absorbing capacity, so that an ink can be effectively absorbed therein. Therefore, they can effectively prevent the expansion and contraction of the cellulose caused by ink absorption. These porous fillers may be used either singly or in any combination thereof. The porous filler preferably has pores having a pore diameter of 10 to 100 nm.

The amount of the porous filler added to the porous cellulose layer is preferably from 5% by mass to 20% by mass in terms of ash content based on the whole of the porous cellulose layer. When the amount is 5% by mass or greater, the deformation of the cellulose fibers can be effectively inhibited. When the amount is 20% by mass or less, the amount of paper dust generated can be lessened. Incidentally, in this case, the content of the porous filler is indicated in terms of ash content, and the measurement of the ash content can be conducted in accordance with JIS P 8128.

In the present invention, the porous filler is filled into pores between the cellulose fibers making up the porous cellulose layer. In order to effectively inhibit cockling in the present invention, it is preferable to uniformly distribute the porous filler in the in-plane direction of the porous cellulose layer. In the present invention, the in-plane direction means all direction perpendicular to the thickness-wise direction of the recording medium. The porous filler is uniformly distributed in the in-plane direction, whereby ink can be uniformly absorbed in the in-plane direction of the recording medium to more effectively prevent the occurrence of cockling and the like.

As shown in FIGS. 1 and 2, the average particle size of the porous filler is smaller than the average pore diameter of the pores formed between the cellulose fibers. In the present invention, the porous filler is preferably present in such a manner that one porous filler particle comes into contact with one cellulose fiber or comes into no contact with any cellulose fiber.

The average pore diameter of the pores formed between the cellulose fibers used in the present invention is preferably within a range of from 5 μm to 10 μm. On the other hand, the average particle diameter of the porous filler is preferably within a range of from 1 μm to 4 μm. Incidentally, the average particle diameter of the porous filler is determined by arbitrarily extracting 20 porous filler particles from a photograph taken through a scanning electron microscope (S4000 (trade name), manufactured by Hitachi Ltd.), measuring a portion of the longest diameter in each porous filler particle and regarding an average value of the longest diameters of the 20 porous filler particles as an average particle diameter.

No particular limitation is imposed on the basis weight of the recording medium according to the present invention so far as the recording medium is not extremely thin due to a low basis weight. The basis weight is preferably within a range of, for example, from 40 $g/m^2$ to 300 $g/m^2$ from the viewpoint of conveyability upon printing by a printer or the like. A more preferred range of the basis weight is from 45 $g/m^2$ to 200 $g/m^2$. When the basis weight falls within this range, the opacity of the paper can be raised without enhancing its folding strength. In addition, blocking is hard to be caused even when a great number of printed samples are stacked. In the present invention, it is not preferable to use an internally loaded sizing agent.

(Production Process of Porous Cellulose Layer)

In the present invention, a porous cellulose layer material and the porous filler are mixed to prepare a liquid dispersion, and a paper is made from this liquid dispersion to produce a recording medium. However, the lightly-beaten cellulose pulp, mercerized cellulose and fluffed cellulose that are materials for the recording medium according to the present invention and the porous filler are different in specific gravity. Therefore, the porous filler may not be sufficiently internally loaded within the porous cellulose layer in some cases according to the production process even though a low-density porous cellulose layer is obtained.

For this reason, the recording medium is produced in the present invention in such a manner that the porous filler is sufficiently internally loaded within the porous cellulose layer. As such processes, may be specifically used the following processes. First of all, a liquid dispersion containing at least one cellulose selected from the group consisting of lightly-beaten cellulose pulp, mercerized cellulose and fluffed cellulose and the porous filler is provided. This liquid dispersion is then used to produce a recording medium in accordance with, for example, the following process.

A) Process of Slowing Down the Dehydration Rate of a Raw Liquid Dispersion in a Wire Part Upon Papermaking by a Paper Machine:

The dehydration rate of a raw liquid dispersion in a wire part upon papermaking is slowed down, whereby a time sufficient to make paper can be imparted while holding the porous filler between cellulose fibers. Therefore, the porous filler can be prevented from running out of the system. In addition, it can be prevented to cause uniform orientation of the cellulose fibers upon dehydration, whereby a recording medium, in which the dispersed state of the cellulose fibers and the porous filler is reflected as it is, and the cellulose fibers are entangled at random, can be provided. As a result, the recording medium can be provided as a recording medium whose density can be made low with a great number of pores maintained between cellulose fibers, and which has sufficient paper strength.

B) Process of Accelerating the Dehydration Speed of a Raw Liquid Dispersion in a Wire Part Upon Papermaking by a Paper Machine:

The dehydration rate of a raw liquid dispersion in a wire part upon papermaking is accelerated, whereby the dispersed state of the cellulose fibers and the porous filler can be rapidly changed from a suspended state to an aggregated state. In this case, there is not enough time to cause uniform orientation of the cellulose fibers and to cause outflow of the porous filler to the outside of the system, so that a recording medium, in which the dispersed state of the cellulose fibers and the porous filler is reflected as it is, can be provided. In addition, a recording medium, which has a low density, and in which the porous filler is filled into a great number of pores formed by the cellulose fibers, can be provided. Incidentally, examples of a method for accelerating the dehydration speed include a method of pressurizing the raw liquid dispersion from above, and a method of sucking the raw liquid dispersion from below the wire part.

C) Process of Mechanically Dispersing Raw Materials:

The fiber form of the cellulose fibers and the dispersed state of the porous filler and the like in the raw liquid dispersion are changed by a mechanical treatment by itself or by its combination with the process A) or B), whereby the entanglement of the cellulose fibers can be increased. In addition, an interaction can be caused between the cellulose fibers and the porous filler to effectively fill the porous filler into pores between the cellulose fibers. As a result, a recording medium, which has a low density, and in which the porous filler is filled into a great number of the pores, can be provided.

As examples of a method of the mechanical treatment, may be mentioned a method of applying shear stress and a method of applying compressive force. It is preferable to apply compressive force to deform the cellulose fibers to flat form. The cellulose fibers are deformed to the flat form, whereby the porous filler can be easily filled between the cellulose fibers.

In the present invention, any of the production processes A) to C) is used, whereby a recording medium, in which the porous filler is filled into the pores in such a state that each porous filler particle comes into contact with one cellulose fiber or comes into no contact with any cellulose fiber, can be provided. Incidentally, in the recording medium according to the present invention, it may also be allowable to control the treatment conditions of the production processes A) to C), or to control the ratio of the average pore diameter of pores to be formed between the cellulose fibers to the average particle diameter of the porous filler according to the necessary filled state of the porous filler.

In the present invention, the average pore diameter of the pores formed between the cellulose fibers making up the porous cellulose layer is preferably within a range of from 5 μm to 10 μm. Incidentally, the average pore diameter can be measured by means of the method (mercury intrusion porosimetry) described in Japanese Patent Publication No. H07-090659.

The pore size of the pores between the cellulose fibers can be controlled by regulating the properties of the materials of the porous cellulose layer and the porous filler. In addition, the pore size of the pores between the cellulose fibers can also be controlled by controlling a dehydration speed upon papermaking and a pressing pressure in a pressing step.

In the present invention, the pore volume of a pore having a pore diameter of 1 μm or smaller in the porous cellulose layer is preferably 0.2 $cm^3/g$ or greater. The pore having the pore diameter within this range is a pore formed as a void between porous filler particles when the porous filler is filled into the pores. The deformation of cellulose by swelling caused by ink absorption can be absorbed by this void portion. The pore volume of a pore having a pore diameter ranging from 1 μm to 10 μm is preferably 0.5 $cm^3/g$ or greater. When the pore volume falls within this range, the porous filler can be prevented from dropping out of the porous cellulose layer.

In the present invention, no material that functions as a binder is fundamentally used in the porous cellulose layer.

(Materials for Forming Ink-Receiving Layer)

Main materials for forming the ink-receiving layer of the recording medium according to the present invention are a porous inorganic pigment and a binder. As the porous inorganic pigment, may be chosen and used one or more of, for example, porous silica, porous calcium carbonate and porous magnesium carbonate. As described above, porous silica is most preferred in that it has a great pore volume. The specific surface area of the porous pigment is preferably 100 $m^2/g$ or larger in that ink absorbency and coloring density can be enhanced.

The binder for the ink-receiving layer in the present invention may be freely selected from among the following water-soluble polymers. For example, polyvinyl alcohol or modified products (cationically modified products, anionically modified products, silanol-modified products) thereof, starch or modified products (oxide, etherified products) thereof, gelatin or modified products thereof, casein or modified products thereof, carboxymethyl cellulose, gum arabic, cellulose derivatives such as hydroxyethyl cellulose and hydroxypropylmethyl cellulose, conjugated diene copolymer latexes such as SBR latexes, NBR latexes and methyl methacrylate-butadiene copolymers, functional group-modified polymer latexes, vinyl copolymer latexes such as ethylene-vinyl acetate copolymers, polyvinyl pyrrolidone, maleic anhydride polymers or copolymers thereof, and acrylic ester copolymers may be preferably used. These binders may be used either singly or in any combination thereof.

The mixing proportion of the binder to the porous inorganic pigment is preferably 5 to 70 parts by mass per 100 parts by mass of the pigment. When the amount of the binder falls within the above range, the mechanical strength of the resulting ink-receiving layer becomes sufficient, and there is no possibility that cracking or powdery coming-off may be caused. In addition, the resulting ink-receiving layer can have good ink absorbency.

In the recording medium according to the present invention, a cationic polymer may be added as needed. A preferable cationic polymer may be suitably chosen for use from among materials such as quaternary ammonium salts, polyamines, alkylamines, quaternary ammonium halides, cationic urethane resins, modified PVA, amine-epichlorohydrin polyaddition products, dihalide-diamine polyaddition products, polyamidine, vinyl (co)polymers, polydiallyldimethylammonium chloride, polymethacryloyloxyethyl-β-hydroxyethyldimethylammonium chloride, polyethylene-imine, polyallylamine and derivatives thereof, polyamide-polyamine resins, cationic starch, dicyanodiamide-formalin condensates, dimethyl-2-hydroxypropylammonium salt polymers, polyvinylamine, dicyanide cationic resins, polyamine cationic resins, epichlorohydrin-dimethylamine addition polymers, dimethyldiamine ammonium chloride-$SO_2$ copolymers, diallylamine salt-$SO_2$ copolymers, (meth)acrylate-containing polymers having a quaternary ammonium base-substituted alkyl group at an ester moiety, styryl type polymers having a quaternary ammonium base-substituted alkyl group, polyamide resins, polyamide-epichlorohydrin resins and polyamide-polyamine-epichlorohydrin resins.

In the present invention, dispersants, thickeners, pH adjustors, lubricants, flowability modifiers, surfactants, antifoaming agents, water-proofing agents, foam suppressors, parting agents, foaming agents, penetrants, coloring dyes, optical whitening agents, ultraviolet absorbents, antioxidants, antiseptics, mildew proofing agents and/or the like may also be added to the above-described materials for forming the ink-receiving layer as needed.

(Process for Forming Ink-Receiving Layer)

In the recording medium according to the present invention, which has an ink-receiving layer, as a process for forming the ink-receiving layer on the porous cellulose layer, an aqueous liquid dispersion composed of the above-described porous inorganic pigment, binder and other additives, and the like is first prepared. This liquid dispersion is then applied on to the porous cellulose layer by means of a coater and dried. As a coating method used in this process, may be used a coating technique by means of a blade coater, air knife coater, roll coater, brush coater, curtain coater, bar coater, gravure coater or sprayer.

When the coating weight of the liquid dispersion falls within a range of from 5 $g/m^2$ to 30 $g/m^2$ in terms of dry solid content, the resulting recording medium can satisfy both ink absorbency and resistance to cockling. The coating weight is more preferably within a range of from 7 $g/m^2$ to 20 $g/m^2$. When the coating weight falls within this range, the surface strength of the ink-receiving layer can be enhanced. After the formation of the ink-receiving layer, the surface smoothness of the ink-receiving layer may also be improved by means of a calender roll or the like as needed.

(Calendering Treatment)

After the porous cellulose layer, in which the porous filler has been internally loaded, or the porous cellulose layer, in which the porous filler has been internally loaded and the ink-receiving layer have been formed, a calendering treatment, a hot calendering treatment or a supercalendering treatment is conducted to smooth the surface of the resulting recording medium. In the present invention, the density of the porous cellulose layer after the smoothing treatment is preferably within a range of from 0.5 $g/cm^3$ to 0.7 $g/cm^3$. When the density is controlled to 0.5 $g/cm^3$ or higher, it is hard to cause cracking upon the formation of the ink-receiving layer. When the density is controlled to 0.7 $g/cm^3$ or lower, the porous filler internally loaded is hard to drop out of the substrate. Incidentally, the density is measured by the method prescribed in JIS P 8118.

(Ink Used in the Image Forming Process of the Present Invention)

The image forming process according to the present invention is a process comprising applying droplets of an ink to the surface of an ink-receiving layer provided on a recording medium or a porous cellulose layer (one surface of the recording medium) to conduct printing. At this time, any of the recording media of the above-described constitutions is used as the recording medium. The ink used in this process mainly comprises a coloring material (dye or pigment), a water-soluble organic solvent and water.

As the dye, is preferably used any of water-soluble dyes typified by, for example, direct dyes, acid dyes, basic dyes, reactive dyes and food colors. However, any dyes may be used so far as they provide images satisfying required performance such as fixing ability, coloring ability, brightness, stability, light fastness and the like in combination with the recording medium of the above-described constitution according to the present invention.

As the pigment, may be used carbon black or the like. In this case, as a method for preparing a pigment ink, may be used a method of using a pigment and a dispersant in combination, a method of using a self-dispersing pigment, a method of microcapsulating a pigment, or the like.

The water-soluble dye is generally used by dissolving it in water or a solvent composed of water and at least one water-soluble organic solvent. As these solvent components and solvents for dispersing the pigment, are used mixtures composed of water and at least one of various water-soluble organic solvents. In this case, it is preferable to control the content of water in an ink within a range of from 20% by mass to 90% by mass.

Examples of the water-soluble organic solvents include alkyl alcohols having 1 to 4 carbon atoms, such as methyl alcohol; amides such as dimethylformamide; ketones and ketone alcohols such as acetone; ethers such as tetrahydrofuran; polyalkylene glycols such as polyethylene glycol; alkylene glycols the alkylene moiety of which has 2 to 6 carbon atoms, such as ethylene glycol; glycerol; and lower alkyl ethers of polyhydric alcohols, such as ethylene glycol methyl ether. One selected from these solvents or a combination of 2 or more solvents selected from these solvents may be used.

Among these many water-soluble organic solvents, polyhydric alcohols such as diethylene glycol, and lower alkyl ethers of polyhydric alcohol, such as triethylene glycol monomethyl ether and triethylene glycol monoethyl ether are particularly preferably used. The polyhydric alcohols are particularly preferred because they have a great effect as a lubricant for preventing a clogging phenomenon of nozzles, which is caused by the evaporation of water in an ink to deposit a water-soluble dye.

A solubilizer may also be added to the ink. Typical solubilizers include nitrogen-containing heterocyclic ketones. Its intended action is to remarkably improve the solubility of a water-soluble dye in a solvent. For example, N-methyl-2-pyrrolidone and 1,3-dimethyl-2-imidazolidinone are preferably used. In order to further improve the properties of the ink, additives such as viscosity modifiers, surfactants, surface tension modifiers, pH adjustors and resistivity regulative agents may also be added for use.

(Printing Method)

As a method for applying such an ink as described above to the recording medium according to the present invention to form an image, is preferred an ink-jet recording method. As such an ink-jet recording method, any system may be used so far as it can effectively eject an ink out of an orifice (nozzle) to apply it to the recording medium. In particular, an ink-jet recording system described in Japanese Patent Application Laid-Open No. S54-059936, in which ink undergoes a rapid volumetric change by an action of thermal energy applied to the ink, and the ink is ejected out of an nozzle by the working force generated by this change of state, may be used effectively.

The present invention will hereinafter be described more specifically by the following Examples. However, the scope of the present invention is not limited by the Examples. A specific method for forming a print on recording media of Examples and Comparative Examples, and evaluation methods as to the resulting prints are as follows.

1) Printing Apparatus:

An Ink-jet Printer 990i (manufactured by Canon Inc.) was used as a recording apparatus to conduct printing on respective recording media of Examples and Comparative Examples. Inks and dyes used in the formation of images are those described below.

Composition of Aqueous Ink (100 Parts by Mass in Total):

| | |
|---|---|
| Dye | 3 parts by mass |
| Surfactant (Surfynol 465, product of Nissin Chemical Industry Co., Ltd.) | 1 part by mass |
| Diethylene glycol | 5 parts by mass |
| Polyethylene glycol | 10 parts by mass |
| Ion-exchanged water | 81 parts by mass |

Dye for ink:
Y: C.I. Direct Yellow 86
M: C.I. Acid Red 35
C: C.I. Direct Blue 199
Bk: C.I. Food Black 2.

2) Recording Medium:

As recording media, those having a size of 210 mm×297 mm were used to form prints, and the prints were evaluated.

The measurements of various properties and evaluation as to the prints obtained above were conducted as follows.

1. Resistance to Curling after Printing:

A square solid pattern of 150 mm×150 mm was printed on a central portion of a recording medium with 2 colors (ink quantity: 200%) by means of the above-described printer. The printed recording medium was then placed on a flat table and left at rest for 1 hour to measure the height of warpage by a height gage (HDM-30A (trade name), manufactured by Mitutoyo Co.), thereby evaluating the recording medium in accordance with the following 5-rank standard. The resistance to curling of the recording medium was ranked as:

"AA" where the height was not more than 1 mm,

"A" where the height was more than 1 mm and not more than 3 mm,

"B" where the height was more than 3 mm and not more than 5 mm,

"C" where the height was more than 5 mm and not more than 7 mm, or

"D" where the height was more than 7 mm.

2. Resistance to Cockling after Printing:

A square solid pattern of 150 mm×150 mm was printed on a central portion of a recording medium with 2 colors (ink quantity: 200%) by means of the printer. The surface of the recording medium right after the printing was visually observed to evaluate the recording medium in accordance with the following 3-rank standard. The resistance to cockling of the recording medium was ranked as:

"A" where neither cockling nor deformation of paper was observed when the recording medium was observed from the front and slant directions of the printed image, "B" where cockling was observed when the recording medium was observed from the slant direction of the printed image, but neither cockling nor deformation of paper was observed when the recording medium was observed from the front direction of the printed image, or "C" where changes such as deformation and cockling were clearly observed when the recording medium was observed from the front direction of the printed image.

3. Elongation Percentage:

A square solid pattern of 150 mm×150 mm was printed on a central portion of a recording medium with 2 colors (ink quantity: 200%) by means of the printer. With respect to the central portion of the printed area in a cross direction of the recording medium, a length of a printing area of the recording medium before the printing, and a length of the printed area after the printing were measured to determine the elongation percentage in accordance with the following equation:

Elongation percentage=(Length of printed area after printing)/(Length of printing area before printing)

4. Absorbency:

A dynamic scanning absorptometer (manufactured by Toyo Seiki Seisaku-sho, Ltd.) was used, and the above-described cyan ink was brought into contact with each recording medium to measure the amount of the ink absorbed, thereby evaluating the recording medium in accordance with the following standard.

The absorbency of the recording medium was ranked as:

"AA" where the amount of the ink transferred with a contact time of 25 milliseconds was not less than 40 $cm^3/m^2$, "A" where the amount of the ink transferred with a contact time of 25 milliseconds was not less than 30 $cm^3/m^2$ and less than 40 $cm^3/m^2$, "B" where the amount of the ink transferred with a contact time of 25 milliseconds was not less than 20 $cm^3/m^2$ and less than 30 $cm^3/m^2$, "C" where the amount of the ink transferred with a contact time of 25 milliseconds was not less than 10 $cm^3/m^2$ and less than 20 $cm^3/m^2$, or "D" where the amount of the ink transferred with a contact time of 25 milliseconds was less than 10 $cm^3/m^2$.

5. Resistance to Strike-Through:

Solid printing with from a single color to 3 colors was conducted by means of the printer. The print thus obtained was left to stand for 1 hour after the printing, and the recording medium was then visually observed from the side opposed to the printed surface to check whether strike-through occurred or not, thereby evaluating the recording medium in accordance with the following standard. The resistance to strike-through of the recording medium was ranked as:

"A" where no strike-through occurred with an ink quantity of 300% (3-color mixing), "B" where no strike-through occurred with an ink quantity of 200% (2-color mixing), "C" where no strike-through occurred with an ink quantity of 100% (single color), or "D" where strike-through occurred with an ink quantity of 100%.

Other measurements were conducted in accordance with the following respective methods.

A) Canadian Standard Freeness:

Measured in accordance with the method prescribed in JIS P 8121.

B) Ash Content of the Porous Cellulose Layer (Corresponding to the Amount of a Porous Filler Added to a Porous Cellulose Layer):

Measured in accordance with the method prescribed in JIS P 8128.

C) Density

The densities of a porous cellulose layer and a porous cellulose layer, on which an ink-receiving layer has been formed, before and after a calendering treatment were measured in accordance with the method prescribed in JIS P 8118.

D) Filling Rate of Porous Filler:

A section of a substrate (porous cellulose layer) is observed at 3,000 magnifications through an electron microscope. The observed region is subjected to elemental analysis to check the presence of carbon and silicon. The observed region is divided into the following 3 portions on the basis of the determined result to determine areas of the respective regions. A filling rate of the porous filler is calculated from the areas thus determined.

(1) A portion where carbon was detected: cellulose is present, (2) A portion where silicon was detected: the porous filler is present, and (3) A portion where neither carbon nor silicon was detected: a pore between cellulose fibers.

Filling rate=(Portion where silicon was detected)/[(Portion where silicon was detected)+(Portion where neither carbon nor silicon was detected)]×100.

E) Confirmation of Filled State of Porous Filler:

The filled state of a porous filler in each of recording media produced in Examples was confirmed in accordance with the procedure described in the specification. As a result, it was found that all porous filler particles present in pores formed by cellulose fibers were filled so as to come into contact with one cellulose fiber or come into no contact with any cellulose fiber.

Example 1

LBKP (Canadian standard freeness: 680 ml) obtained by using, as a raw material, mangrove chips (weight per volume: 700 $kg/m^3$), product of Borneo, was beaten by a double disk refiner to adjust its Canadian standard freeness to 600 ml, thereby obtaining raw pulp.

As a porous filler, 10% by mass (in terms of ash content) of silica (Sipernat 350 (trade name), particle diameter: 3 μm, specific surface area: 50 $m^2/g$, product of Degussa AG) was mixed with the raw pulp to prepare a raw material (material for porous cellulose layer) for paper.

The above-described raw material for paper was used to make a paper having a basis weight of 80 $g/m^2$ by means of a Fourdrinier paper machine. The surface of the thus-obtained paper was smoothed by means of a supercalender composed of a metal roll and a resin roll having a D hardness of 85° at a metal roll temperature of 70° C. and a linear pressure of 200 kg/cm to obtain a recording medium according to EXAMPLE 1.

Example 2

A recording medium according to EXAMPLE 2 was produced in the same manner as in EXAMPLE 1 except that the same raw pulp as that used in EXAMPLE 1 was used and beaten by the same machine as that used in EXAMPLE 1 to adjust its Canadian standard freeness to 550 ml, thereby obtaining raw pulp.

Example 3

A recording medium according to EXAMPLE 3 was produced in the same manner as in EXAMPLE 1 except that the same pulp having a Canadian standard freeness of 550 ml as that prepared in EXAMPLE 2 and commercially available LBKP having a Canadian standard freeness of 450 ml were adjusted to obtain raw pulp having a Canadian standard freeness of 500 ml.

Example 4

An aqueous solution of sodium hydroxide having a concentration of 15% by mass was added to an unbeaten product of Nadelholz (coniferous) bleached kraft pulp (NBKP) so as to give a pulp concentration of 5% by mass, and the pulp was immersed at 20° C. for 30 minutes to mercerize it. After the mercerized pulp was then fully washed with water and adjusted to pH 7, hot water was added so as to give a pulp concentration of 5% by mass, the resultant pulp slurry was treated for 2 hours at 70° C., and pulp was then separated from hot water by means of a centrifugal dehydrator to obtain bulky pulp. The content of cellulose II in the resultant bulky pulp was measured in accordance with the method described in Japanese Patent Application Laid-Open No. 2003-293284. As a result, it was found to be 100% by mass. Thirty parts by mass of the bulky pulp was mixed with 70 parts by mass of Laulholz (deciduous) bleached kraft pulp (LBKP) (Canadian standard freeness: 550 ml) to obtain raw pulp. To the raw pulp was added 10% (in terms of ash content) of the same porous filler as that used in EXAMPLE 1 to prepare a raw material for paper.

A paper having a basis weight of 80 g/m$^2$ was made by means of the same Fourdrinier paper machine as that used in EXAMPLE 1. The same supercalender as that used in EXAMPLE 1 was used to smooth the resultant paper under the same conditions as in EXAMPLE 1, thereby obtaining a recording medium according to EXAMPLE 4.

Example 5

A recording medium according to EXAMPLE 5 was produced in the same manner as in EXAMPLE 1 except that fluffed cellulose (NHB405 (trade name), product of WEYERHAEUSER CO., curl factor: 0.70) was beaten by the same method as in EXAMPLE 1 to adjust its Canadian standard freeness to 600 ml, thereby obtaining raw pulp.

Example 6

A recording medium according to EXAMPLE 6 was produced in the same manner as in EXAMPLE 1 except that a porous filler obtained by wet grinding silicate (Sipernat 820A (trade name), particle diameter: 5 μm, specific surface area: 85 m$^2$/g, product of Degussa AG) to adjust its particle diameter to 4 μm was used in place of the porous filler used in EXAMPLE 1.

Example 7

A recording medium according to EXAMPLE 7 was produced in the same manner as in EXAMPLE 1 except that a porous filler obtained by wet grinding calcium silicate (CM-F (trade name), particle diameter: 1.4 μm, specific surface area: 70 m$^2$/g, product of TOKUYAMA Corp.) to adjust its particle diameter to 1 μm was used in place of the porous filler used in EXAMPLE 1.

Example 8

A recording medium according to EXAMPLE 8 was produced in the same manner as in EXAMPLE 1 except that a soft calender composed of a metal roll and a resin roll having a D hardness of 90° was used in place of the supercalender used in EXAMPLE 1 to smooth the surface of the paper at a metal roll temperature of 130° C. and a linear pressure of 250 kg/cm.

Example 9

In ion-exchanged water were dispersed 100 parts by mass of dry silica (REOLOSIL QS-20 (trade name), product of TOKUYAMA Corp., BET specific surface area: 220 m$^2$/g), 30 parts by mass of polyvinyl alcohol (PVA 117 (trade name), product of Kuraray Co., Ltd.) and 20 parts by mass of a cationic dye fixing agent (Sumirez Resin 1001 (trade name), product of Sumitomo Chemical Co., Ltd.) to prepare a liquid dispersion for coating having a dry solid content concentration of 20% by mass. The resultant liquid dispersion for coating was then applied on to the porous cellulose layer obtained in EXAMPLE 1 by means of a bar coater and then dried to form a porous ink-receiving layer having a solid content of 10 g/m$^2$. The surface of the porous ink-receiving layer was then smoothed by means of a supercalender composed of a metal roll and a resin roll having a D hardness of 85° at a metal roll temperature of 100° C. and a linear pressure of 200 kg/cm to obtain a recording medium according to EXAMPLE 9.

Example 10

A recording medium according to EXAMPLE 10 was produced in the same manner as in EXAMPLE 9 except that 100 parts by mass of wet silica (FINESIL X45 (trade name), product of TOKUYAMA Corp., BET specific surface area: 280 m$^2$/g), 30 parts by mass of silicon-modified polyvinyl alcohol (R1130 (trade name), product of Kuraray Co., Ltd.) and 10 parts by mass of a cationic resin (PAS-J81 (trade name), product of Nittobo Incorporated) were used in place of the ink-receiving layer materials used in EXAMPLE 9.

Example 11

Papermaking and supercalendering were conducted in the same manner as in EXAMPLE 1 except that the same raw pulp and porous filler as those used in EXAMPLE 1 were used to change the basis weight to 64 g/m$^2$, thereby obtaining a recording medium according to EXAMPLE 11.

Example 12

Papermaking and supercalendering were conducted in the same manner as in EXAMPLE 1 except that the same raw pulp and porous filler as those used in EXAMPLE 1 were used to change the amount of the porous filler added to 20% by mass (in terms of ash content), thereby obtaining a recording medium according to EXAMPLE 12.

Example 13

A recording medium according to EXAMPLE 13 was produced in the same manner as in EXAMPLE 1 except that the porous filler (particle diameter: 5 μm) used in EXAMPLE 6 was wet-ground to adjust the particle diameter to 4.2 μm, and this porous filler was used.

Example 14

A recording medium according to EXAMPLE 14 was produced in the same manner as in EXAMPLE 1 except that the porous filler (particle diameter: 1.4 μm) used in EXAMPLE 7 was ground to adjust the particle diameter to 0.9 μm, and this porous filler was used.

Comparative Example 1

Paper having a basis weight of 80 g/m$^2$ was made in the same manner as in EXAMPLE 1 except that no porous filler was used, thereby obtaining a recording medium according to COMPARATIVE EXAMPLE 1. After the papermaking, no calendering treatment was conducted.

Comparative Example 2

A recording medium was produced in the same manner as in EXAMPLE 1 except that no porous filler was used, thereby obtaining a recording medium according to COMPARATIVE EXAMPLE 2.

Comparative Example 3

A porous cellulose layer was formed in the same manner as in EXAMPLE 9 except that no porous filler was used, and an ink-receiving layer having a dry solid content of 10 g/m$^2$ was formed on the surface of the porous cellulose layer to obtain a recording medium according to COMPARATIVE EXAMPLE 3.

Comparative Example 4

Paper was made in the same manner as in EXAMPLE 1 except that raw pulp obtained by beating commercially available LBKP to adjust its Canadian standard freeness to 490 ml was used, thereby obtaining a recording medium according to COMPARATIVE EXAMPLE 4. After the papermaking, no calendering treatment was conducted.

Comparative Example 5

A recording medium according to COMPARATIVE EXAMPLE 5 was produced in the same manner as in EXAMPLE 1 except that raw pulp obtained by beating a commercially available LBKP to adjust its Canadian standard freeness to 490 ml was used.

Comparative Example 6

A porous cellulose layer was formed in the same manner as in EXAMPLE 9 except that raw pulp obtained by beating commercially available LBKP to adjust its Canadian standard freeness to 490 ml was used, thereby obtaining a recording medium according to COMPARATIVE EXAMPLE 6.

Incidentally, the raw pulp adjusted to the Canadian standard freeness of 600 ml in EXAMPLES 1 and 5 to 14 and the raw pulp adjusted to the Canadian standard freeness of 550 ml in EXAMPLES 2 to 4 were respectively observed at 500 magnifications through a scanning electron microscope (S4000 (trade name), manufactured by Hitachi Ltd.). As a result, no fibril was observed on the surfaces of cellulose fibers. The raw pulp adjusted to the Canadian standard freeness of 490 ml in COMPARATIVE EXAMPLES 4 to 6 was observed likewise. As a result, a great number of fibrils were observed on the surfaces of cellulose fibers.

The evaluation results as to the resistance to curling, resistance to cockling, elongation percentage, absorbency and resistance to strike-through in the recording media produced in EXAMPLES 1 to 14 and COMPARATIVE EXAMPLES 1 to 6 are shown in Table 1.

TABLE 1

| | Density | | | Filling | | | | | |
|---|---|---|---|---|---|---|---|---|---|
| | Before calender | After calender | Thickness (μm) | rate (%) | Evaluation result *1 | *2 | *3 | *4 | *5 |
| EX. 1 | 0.51 | 0.72 | 111 | 90 | AA | A | 1.3 | AA | A |
| EX. 2 | 0.53 | 0.72 | 111 | 90 | A | A | 1.5 | A | A |
| EX. 3 | 0.54 | 0.72 | 111 | 90 | A | A | 1.7 | A | A |
| EX. 4 | 0.45 | 0.70 | 114 | 90 | AA | A | 1.2 | AA | A |
| EX. 5 | 0.45 | 0.70 | 114 | 90 | AA | A | 1.1 | AA | A |
| EX. 6 | 0.50 | 0.70 | 114 | 90 | AA | A | 1.3 | AA | A |
| EX. 7 | 0.53 | 0.72 | 111 | 90 | A | A | 1.5 | AA | A |
| EX. 8 | 0.51 | 0.73 | 110 | 90 | A | A | 1.3 | A | A |
| EX. 9 | 0.60 | 0.73 | 123 | 90 | A | A | 1.1 | A | A |
| EX. 10 | 0.60 | 0.73 | 123 | 90 | A | A | 1.1 | B | A |
| EX. 11 | 0.48 | 0.71 | 90 | 90 | A | A | 1.3 | B | A |
| EX. 12 | 0.40 | 0.69 | 116 | 95 | AA | A | 1.1 | AA | A |
| EX. 13 | 0.53 | 0.70 | 114 | 90 | B | A | 1.5 | A | A |
| EX. 14 | 0.50 | 0.70 | 114 | 90 | B | A | 1.5 | A | A |
| COMP. EX. 1 | 0.51 | | 157 | 0 | A | B | 2.3 | AA | D |
| COMP. EX. 2 | 0.51 | 0.72 | 111 | 0 | A | C | 2.0 | AA | B |
| COMP. EX. 3 | 0.60 | 0.73 | 123 | 0 | D | C | 1.7 | A | A |
| COMP. EX. 4 | 0.53 | | 151 | 80 | C | C | 2.3 | C | D |

TABLE 1-continued

| | Density | | | Filling | | | | | |
|---|---|---|---|---|---|---|---|---|---|
| | Before calender | After calender | Thickness (μm) | rate (%) | Evaluation result *1 | *2 | *3 | *4 | *5 |
| COMP. EX. 5 | 0.53 | 0.70 | 114 | 80 | C | C | 2.0 | C | A |
| COMP. EX. 6 | 0.53 | 0.70 | 129 | 80 | D | C | 1.7 | B | A |

Note:
*1: Resistance to curling,
*2: Resistance to cockling,
*3: Elongation percentage,
*4: Absorbency,
*5: Resistance to strike-through.

As apparent from the results shown in Table 1, in the recording media according to EXAMPLES 1 to 14, all the evaluation results as to the resistance to curling, resistance to cockling, absorbency and resistance to strike-through were B or better, and the elongation percentages of almost all media were 1.5 or lower. On the other hand, in the recording media according to COMPARATIVE EXAMPLES, at least one of the evaluation results was C or worse. Although the evaluation as to the resistance to cockling in the recording medium according to COMPARATIVE EXAMPLE 1 was B because its thickness was 157 μm. However, the evaluation as to the resistance to strike-through was D. In the recording media according to COMPARATIVE EXAMPLES 1, 2, 4 and 5, which had no ink-receiving layer, their elongation percentages were 2.0 or higher. Accordingly, it is understood that the cockling and curling can be effectively prevented by providing the recording media of the constitutions according to the present invention.

This application claims priorities from Japanese Patent Application Nos. 2005-203047 filed Jul. 12, 2005, and 2006-187840 filed on Jul. 7, 2006, which are hereby incorporated by reference herein.

What is claimed is:

1. A recording medium comprising a substrate alone, wherein the substrate contains (a) at least one cellulose selected from the group consisting of lightly-beaten cellulose pulp, mercerized cellulose, and fluffed cellulose, and (b) a porous filler, wherein the substrate contains the porous filler in an amount of from 5% by mass to 20% by mass in terms of ash content, wherein the average pore diameter of pores formed between fibers of the cellulose contained in the substrate is from 5 μm to 10 μm, and wherein the average particle diameter of the porous filler is from 1 μm to 4 μm.

2. The recording medium according to claim 1, wherein the porous filler is distributed in an in-plane direction of the recording medium.

3. The recording medium according to claim 1, wherein the porous filler is internally loaded in such a manner that each particle of the porous filler comes into contact with only one fiber of the cellulose or comes into no contact with any fiber of the cellulose.

4. The recording medium according to claim 1, wherein the substrate has a density of 0.7 g/cm$^3$ or lower.

5. The recording medium according to claim 1, wherein the porous filler is at least one of silica and silicate.

6. The recording medium according to claim 1, wherein the lightly-beaten cellulose pulp has a Canadian standard freeness of at least 500 ml.

7. The recording medium according to claim 1, wherein the recording medium is a recording medium for ink-jet recording.

8. An image forming process comprising forming an image by an ink-jet recording method, wherein the recording medium according to claim 1 is used as the recording medium.

9. The recording medium according to claim 1, wherein the substrate is such that a pore volume of a pore having a pore diameter ranging from 1 μm to 10 μm is 0.5 cm$^3$/g or greater.

10. A recording medium comprising:

a substrate; and an ink-receiving layer provided on the substrate, wherein the substrate comprises a porous cellulose layer containing (a) at least one cellulose selected from the group consisting of lightly-beaten cellulose pulp, mercerized cellulose, and fluffed cellulose, and (b) a porous filler, wherein the substrate contains the porous filler in an amount of from 5% by mass to 20% by mass in terms of ash content, wherein the average pore diameter of pores formed between fibers of the cellulose contained in the substrate is from 5 μm to 10 μm, and wherein the average particle diameter of the porous filler is from 1 μm to 4 μm.

11. The recording medium according to claim 10, wherein the porous filler is distributed in an in-plane direction of the recording medium.

12. The recording medium according to claim 10, wherein the porous filler is internally loaded in such a manner that each particle of the porous filler comes into contact with only one fiber of the cellulose or comes into no contact with any fiber of the cellulose.

13. The recording medium according to claim 10, wherein the porous cellulose layer has a density of 0.7 g/cm$^3$ or lower.

14. The recording medium according to claim 10, wherein the porous filler is at least one of silica and silicate.

15. The recording medium according to claim 10, wherein the lightly-beaten cellulose pulp has a Canadian standard freeness of at least 500 ml.

16. The recording medium according to claim 10, wherein the recording medium is a recording medium for ink-jet recording.

17. An image forming process comprising forming an image by an ink-jet recording method, wherein the recording medium according to claim 10 is used as the recording medium.

* * * * *